US005794885A

United States Patent [19]

Husek et al.

[11] Patent Number: 5,794,885

[45] Date of Patent: Aug. 18, 1998

[54] WEAVING LOOM WITH A FABRIC WINDING MANDREL TROLLEY

[75] Inventors: Jiri Husek, Varnsdorf; Valdemar Honcu, Rumburk; Alfred Beer, Jablonec n.N, all of Germany

[73] Assignee: Lindauer Dornier Gesellschaft mbH, Lindau, Germany

[21] Appl. No.: 822,297

[22] Filed: Mar. 21, 1997

[30] Foreign Application Priority Data

Mar. 22, 1996 [DE] Germany ..... 296 05 339.2

[51] Int. Cl.[6] ..... B65H 18/04

[52] U.S. Cl. ..... 242/533.8; 242/545; 242/530.1; 242/547; 139/304

[58] Field of Search ..... 242/533.8, 545, 242/528, 530.1, 547, 541.5; 28/190, 194, 196, 200; 139/304, 307, 308

[56] References Cited

U.S. PATENT DOCUMENTS

| | | | |
|---|---|---|---|
| 89,048 | 4/1869 | Hussey | 242/541.5 |
| 2,728,130 | 12/1955 | Luchansky | 28/200 |
| 4,606,381 | 8/1986 | Suwa | 139/304 |
| 4,817,882 | 4/1989 | Brewer et al. | 242/533.8 |
| 5,135,601 | 8/1992 | Klose et al. | 242/533.8 |
| 5,282,584 | 2/1994 | Yano | 242/533.8 |
| 5,435,501 | 7/1995 | Alexander et al. | 242/533.8 |
| 5,470,030 | 11/1995 | Nielsen et al. | 242/533.8 |

*Primary Examiner*—John M. Jillions

*Attorney, Agent, or Firm*—W. G. Fasse; W. F. Fasse

[57] ABSTRACT

A weaving loom is equipped with a trolley or several trolleys, each of which carries a cloth winding mandrel. A single drive which is either separate from the main loom drive or which derives its power from the main loom drive is provided to drive one or more fabric winding mandrels in series. The trolley with its mandrel or a plurality of trolleys take up the space conventionally taken up by a cloth beam, whereby substantial floor space on the factory floor is saved.

16 Claims, 3 Drawing Sheets

FIG.3
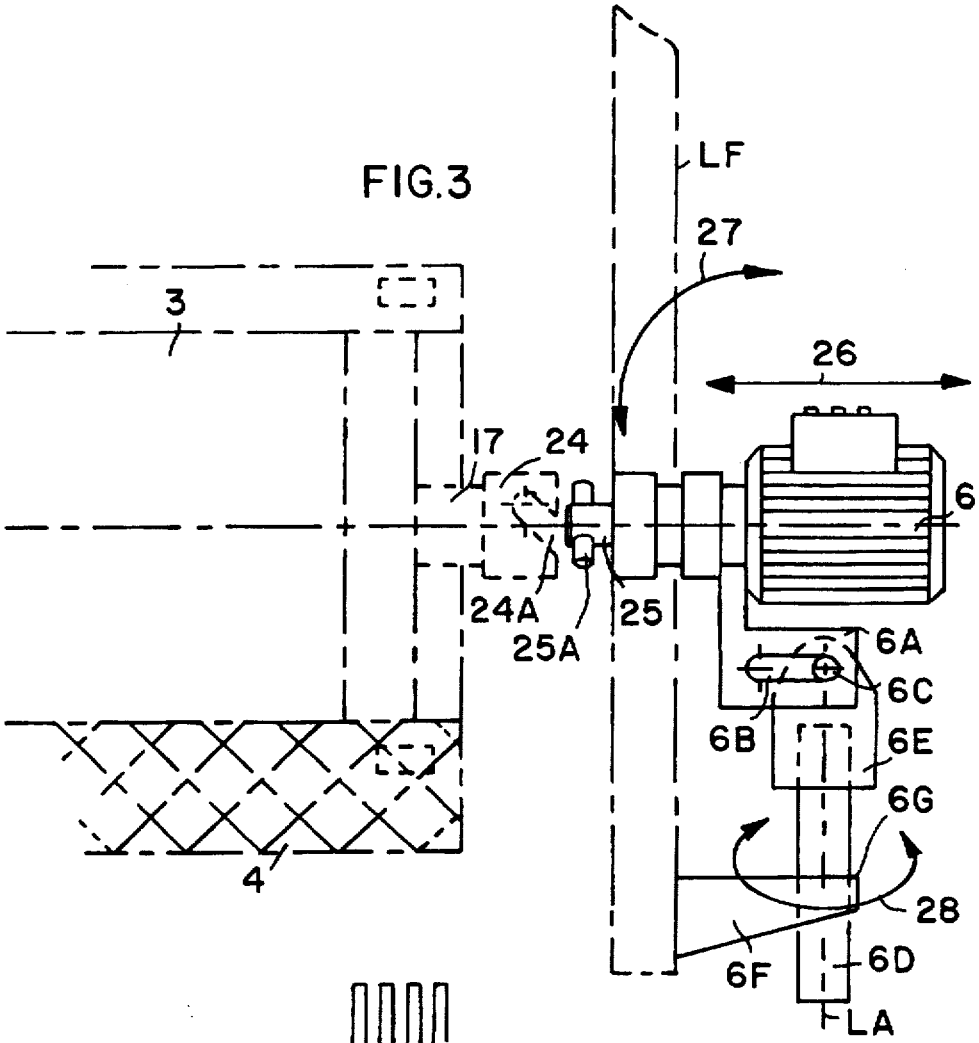
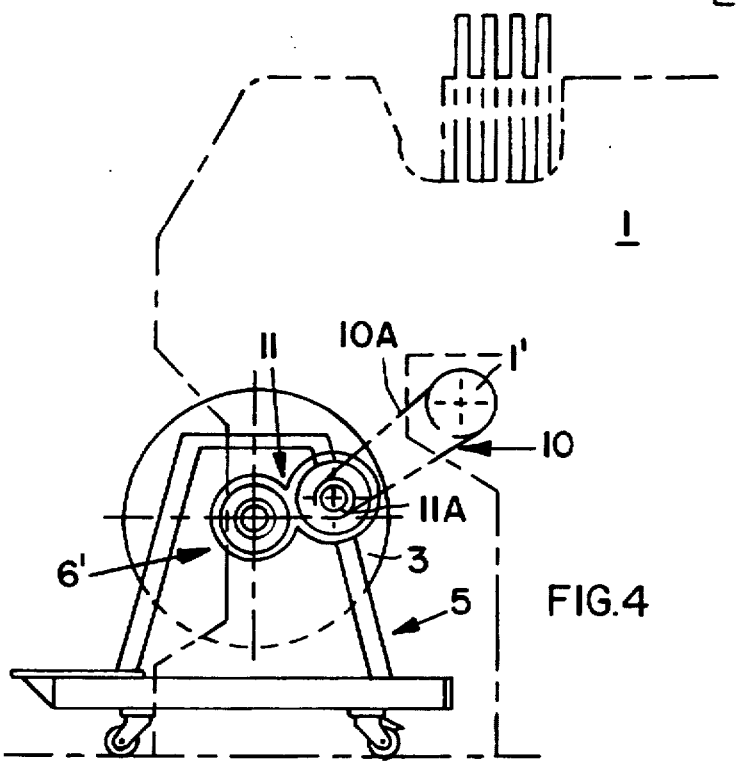
FIG.4

WEAVING LOOM WITH A FABRIC WINDING MANDREL TROLLEY

FIELD OF THE INVENTION

The invention relates to the combination of a weaving loom with a trolley carrying a fabric winding mandrel for winding the fabric onto the mandrel. The trolley with its mandrel replaces a cloth beam. The invention also relates to such a trolley and mandrel.

BACKGROUND INFORMATION

It is generally known to wind the fabric produced in a loom onto a cloth beam which is mounted within the loom. At least one such cloth beam is integrated into the loom. The cloth beam is driven in synchronism with the weaving operation, whereby the drive of the cloth beam is such that a certain fabric withdrawal tension is maintained. A fully wound cloth beam is heavy and requires for its replacement lifting and transport equipment that also brings an empty cloth beam into a position in the loom after a full beam has been removed. The lifting and transport equipment is constructed to minimize manual operations in the exchange of a full cloth beam with an empty cloth beam. Two transport trolleys are required, one for carrying an empty cloth beam into the loom, the other for removing a full cloth beam from the loom. These conventional transport trolleys are equipped with gripper arms for manipulating the cloth beam. An empty transport trolley is moved next to a loom with a full cloth beam and the gripper arms seize the full cloth beam to transfer it into the transport trolley.

It is also known to use so-called ascending batch winders or rising roll batchers which are arranged outside the weaving loom. These rising roll batchers are either equipped with a center drive or cooperate with winding rollers that apply the required drive to the cloth beam by friction. A winding roller drive may comprise a three phase motor or a direct current motor or a combined electric hydraulic drive.

Further known are so-called loom fabric winders or loom lappers which are positioned outside the weaving loom and which wind the fabric outside the loom proper. The winding of the fabric takes place from the center of a cloth beam by a special winding drive including an electric motor. These drives comprise, for example, a so-called lower r.p.m. full power output electric motor also referred to as "standstill drives" due to their low r.p.m. These drives are capable to deliver the maximum torque even at very low r.p.m.s. The tension applied to the fabric can be controlled through a transformer that supplies the operating power to the low r.p.m. drive motor.

U.S. Pat. No. 5,470,030 (Nielsen et al.), issued on Nov. 28, 1995, discloses a fabric take-up frame for a loom in which a winding roller is mounted in a frame for winding the fabric onto the roller, and whereby the roller is driven by a separate power drive including a variable speed drive motor. Special arrangements are made for controlling the fabric tension.

On the one hand, fabric winding equipment which winds the produced fabric onto a take-up roller outside of the loom proper, requires a substantially larger surface area on the factory floor than a loom with a cloth beam mounted inside the loom and having the same width or length as the weaving width of the loom. The additional factory floor surface area required for fabric winding equipment positioned outside the loom proper may range up to one third of the factory floor area required for the loom. On the other hand, when a cloth beam that is an integral part of the loom is full, it must be exchanged against an empty cloth beam which also requires floor space for the exchange equipment positioned outside the loom proper. Such exchange equipment includes a so-called cloth beam lift and transport carriage which must be maneuverable on floor space next to the loom, whereby this space must be provided between neighboring looms arranged in a row on the factory floor. Thus, whether the cloth beam is mounted in the loom frame, or mounted outside the loom frame there is the disadvantage that a relatively expensive production floor space must be made available for the movement of the respective carriages for removing a full beam from the loom and for positioning an empty beam, either in the loom or outside the loom on a so-called fabric winder or loom lapper.

OBJECTS OF THE INVENTION

In view of the above it is the aim of the invention to achieve the following objects singly or in combination:

- to provide a loom which cooperates with a fabric winding roller in such a way that floor space can be saved compared to conventional solutions of the problem;
- to provide fabric winding rollers which can have a larger winding capacity compared to conventional cloth beams by avoiding lifting full cloth beams next to or out of the loom;
- to arrange a fabric winding mandrel supported by its own trolley within the confines of a loom frame, thereby replacing the cloth beam;
- to arrange more than one, for example, two fabric winding mandrels in axial alignment with each other on one or two trolleys so that a single drive can drive both fabric winding mandrels; and
- to provide a trolley carrying at least one fabric winding mandrel for the above purposes.

SUMMARY OF THE INVENTION

According to the invention there is provided a weaving loom combined with at least one, preferably more, transport trolleys each carrying one winding mandrel, and wherein a single winding drive is provided for one or more fabric winding mandrels.

The mandrel carrying transport trolley according to the invention is characterized in that a trolley frame carries two upright members mounted on the trolley frame which itself is supported by wheels, preferably swivel wheels that permit steering the trolley, which preferably has an elongated configuration fitting into the loom frame in a space which conventionally held the cloth beam. Two bearings, one of which is mounted in each of the upright members support a fabric winding mandrel in a rotatable manner. Stop members on the trolley permit positioning the trolley in a precise position in the weaving loom by cooperation with further stop members in the loom itself to precisely align the winding mandrel with the fabric output of the loom such as a spreader roller. A releasable coupling is provided at least at one end of the mandrel for releasably connecting the mandrel to a single power drive. Where both ends of a mandrel or a mandrel supporting shaft are equipped with coupling elements, the mandrels can be connected in series with each other even if they are supported rotatably on different trolleys so that a single drive motor can operate two mandrels in series.

According to the invention the space conventionally taken up by the cloth beam is now used for at least one trolley, preferably two or more trolleys, each carrying its own fabric winding mandrel, whereby the coupling is such that the mandrel or mandrels may be driven selectively either by a single separate power drive that is independent of the main loom drive or by a single drive that derives its power for driving the mandrels from the main loom drive.

The transport trolley according to the invention has an elongated steerable trolley frame or carriage which supports two upright members such as upright posts or side walls or A-frames spaced from each other to take up the fabric winding mandrel in bearings permitting the rotation of the mandrel. The trolley is further equipped with at least two positioning members to precisely position the trolley in the loom for taking up the fabric and with two interlocking devices for locking the trolley in a precise position in which the fabric winding mandrel or mandrels are aligned with the fabric stretcher roller of the loom.

Other important features of the trolley are seen in that a stepping board is arranged to extend preferably along the entire length of the trolley for use by an operator. Additionally, the upright members such as posts or side walls or A-frames may carry mounting brackets with vertical guide slots for mounting a so-called ironing or smoothing roller which rests on the fabric being wound onto the mandrel. Preferably, the smoothing roller extends with its axis in parallel to the axis of the mandrel. As the diameter of the mandrel increases by taking up fabric, the smoothing roller rides in its guide slots up to accommodate the increased diameter of the mandrel. The arrangement is such, that the smoothing roller will always press onto the fabric being wound onto the mandrel regardless how much fabric has been accumulated on the mandrel. However, it is also possible to rotatably mount the smoothing roller in the loom frame.

Advantages of the invention are seen in that a reloading of a cloth beam out of the loom onto a cloth beam transport trolley is avoided. Further, a reloading of the cloth beam from a transport carriage onto other devices for inspection purposes and for subsequent finishing treatments of the fabric are no longer necessary because the present cloth or fabric mandrels on their trolleys can be used for these purposes. The need for extra factory floor space has been optimally reduced so that the floor space between neighboring looms can now be used more efficiently, whereby more looms can be positioned on a given surface area than was possible heretofore.

BRIEF DESCRIPTION OF THE DRAWINGS

In order that the invention may be clearly understood, it will now be described, by way of example, with reference to the accompanying drawings, wherein:

FIG. 3 illustrates, on an enlarged scale compared to FIG. 1, the mounting of a separate drive for one or more mandrels; and FIG. 4 illustrates a single drive for one or more fabric winding mandrels, whereby the drive power is derived from a main loom drive.

DETAILED DESCRIPTION OF PREFERRED EXAMPLE EMBODIMENTS AND OF THE BEST MODE OF THE INVENTION

Figure 1:
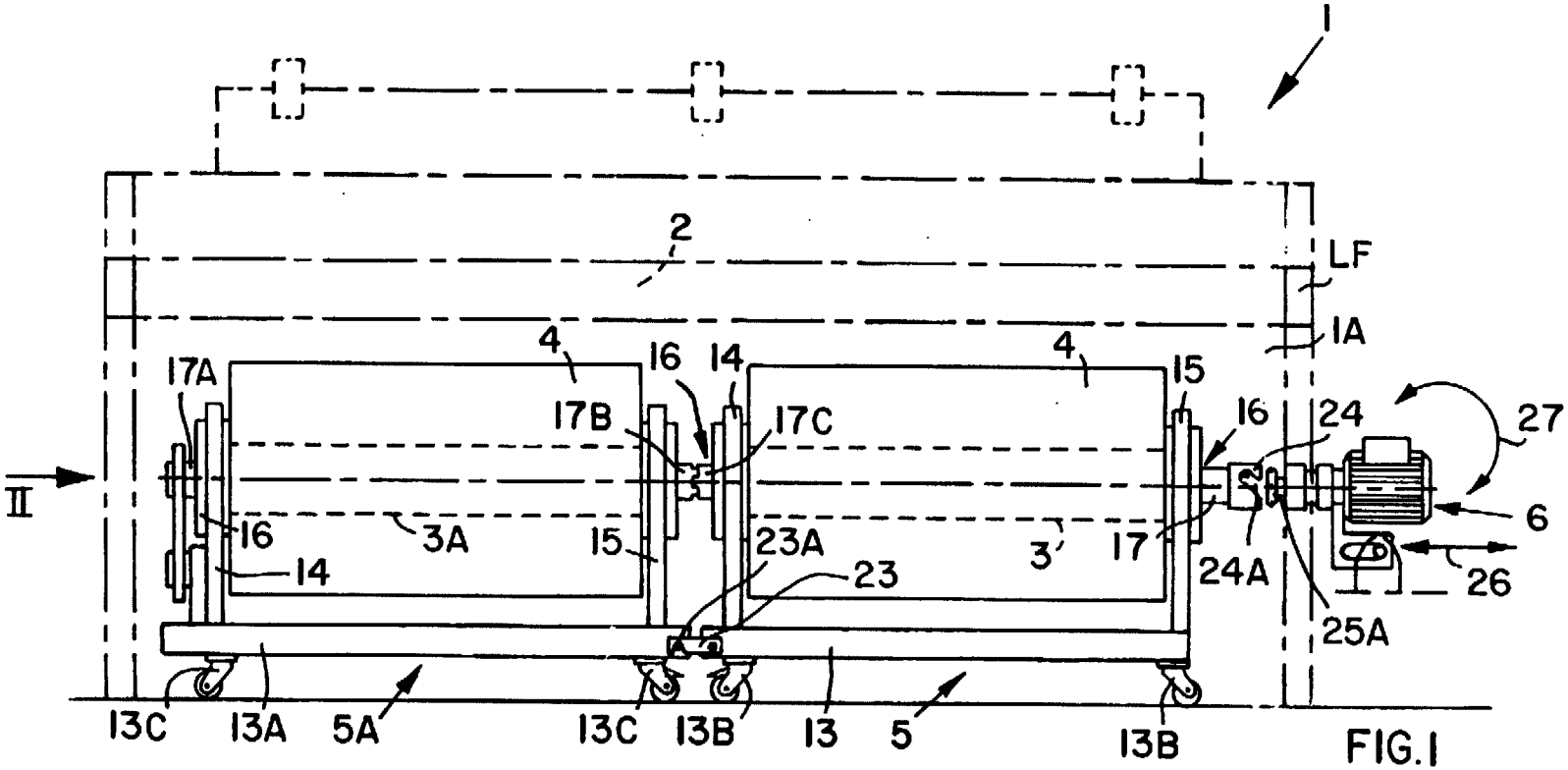
FIG. 1 is a schematic front view of a loom as viewed in the direction opposite to the fabric advance and illustrating two trolleys according to the invention integrated into a double width loom, each trolley carrying a fabric winding mandrel, wherein all mandrels are driven by a single drive separate from a main loom drive.

FIG. 1 shows a weaving loom 1 with its loom frame LF in dashed lines. According to the invention two trolleys 5 and 5A are positioned in a space 1A within the confines of the loom frame LF. This space 1A was taken up heretofore by the cloth beam. Each trolley 5, 5A has mounted therein a fabric winding mandrel 3, 3A respectively preferably on a respective shaft 17, 17A rotatably mounted in bearings 16. Each trolley 5, 5A comprises a trolley frame or base 13, 13A having mounted thereon upright members 14 and 15 in which the bearings 16 are supported. The trolley frames in turn are supported on swivel wheels 13B, 13C which permit steering the trolleys when the trolleys are not locked to the loom. These swivel wheels 13B and 13C are permitting movement of the trolleys in directions at right angles to each other. Once the trolleys are in proper position within the space 1A, they are interlocked with each other by latch members 23 and 23A and with the loom as will be described below.

A single drive 6 or 6' is mounted to the loom frame for rotating one or more mandrels 3, 3A. The single drive 6 is separate from the main loom drive. However, the single drive 6' as shown in FIG. 4 derives its drive power from the main loom drive 1' as will be described in more detail below with reference to FIG. 4. A releasable coupling 24, 25A is provided between the drive shaft 25 of the power drive 6 which is adjustable in its position as indicated by the double arrows 26, 27 and 28 as will also be described in more detail below with reference to FIG. 3. Where more than one trolley, or rather more than one mandrel 3, 3A are to be driven by the single drive, further coupling elements 17B and 17C are provided at the respective shaft ends to interlock the two mandrels 3, 3A to be driven by the single drive 6 or 6'. For this purpose the shaft 25 of the drive motor 6 has a coupling pin 25A that engages a groove 24A in a coupling head 24 secured to the mandrel shaft 17, whereby a simple, yet readily releasable, coupling is accomplished.

Figure 2:
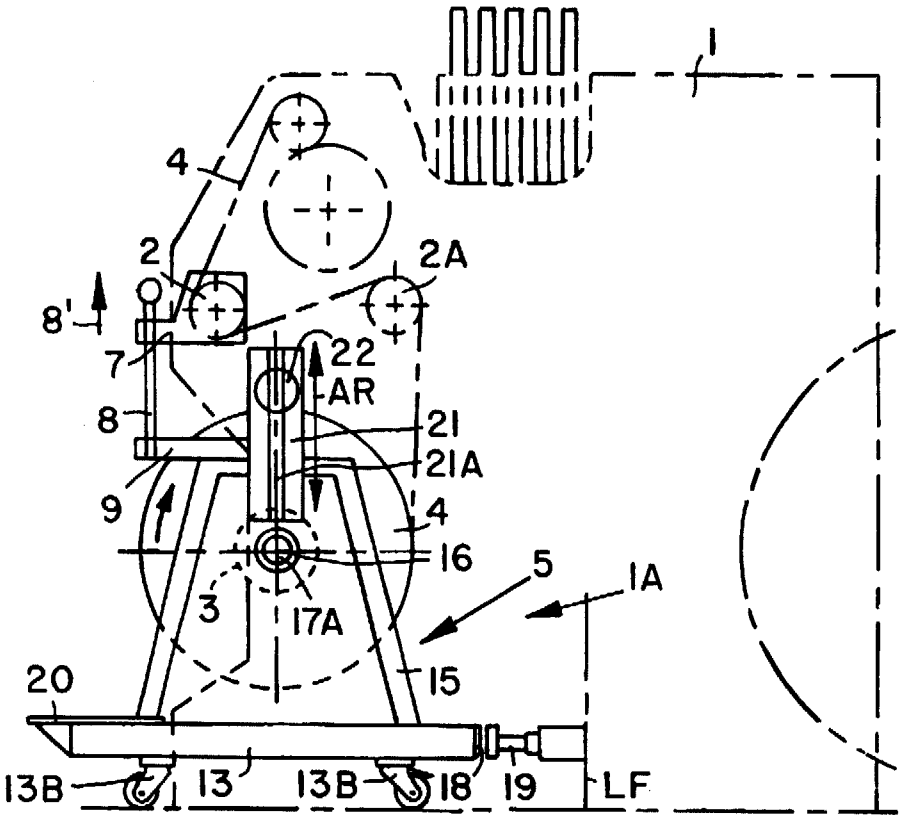
FIG. 2 is a view in the direction of the arrow II in FIG. 1.

FIG. 2 illustrates the components for properly positioning, aligning and interlocking a trolley 13 on its wheels 13B in the space 1A of the loom frame LF. The carriage 13 comprises at least one first positioning stop member 18 on the trolley while the loom 1 comprises at least one second stop member 19 on the loom frame LF. The first and second stop members 18 and 19 cooperate with each other for aligning the trolley with the loom frame so that the fabric 4 travelling over a spreader roller 2 and then over a guide roller 2A can be picked up and wound onto the mandrel 3 which rotates clockwise as shown in FIG. 2. Preferably, at least two first stop members 18 and two second stop members 19 are provided for a precise alignment of the trolley with the loom. These stop members may also have a guide-in function.

In addition to the positioning members 18 and 19, the loom frame and trolley are interlocked with each other by a first locking element 7 rigidly secured to the loom frame and a second locking element 9 such as a bracket rigidly secured to the upright member 15 of the trolley 5. The two locking elements 7 and 9 are preferably provided in duplicate so that one pair of locking elements is positioned at each trolley end where the upright members are positioned, for example in the form of an A-frame or a vertical side wall or the like. An arresting pin 8 engages the two locking elements 7 and 9. The pin 8 will fall in place when the trolley 5 is properly aligned below the spreader roller 2 and guide roller 2A. The pin 8 may be spring biased into the arresting position.

Preferably, a stepping board 20 is mounted to the carriage frame 13 of each trolley 5, 5A. The stepping board 20 preferably runs along the long side of the trolley so that all components on the trolley and respective components on the loom are easily reachable by an operator.

FIG. 2 further shows a mounting bracket 21 with a vertical guide slot 21A positioned in alignment vertically above the mandrel shaft 17 in its bearing 16. A smoothing or ironing roller 22 is guided with its end studs in the guide grooves 21A, one of which is provided at each end of the smoothing roller 22, whereby the smoothing roller can move up or down, depending on how much fabric 4 has already been accumulated on the mandrel 3. When the mandrel is filled it is merely necessary to lift the arresting pin 8 upwardly in the direction of the arrow 8' and the trolley 5 with its filled mandrel can be taken out of the loom space 1A.

FIG. 3 shows the features for adjusting the drive 6 in its position and also the releasable coupling 25A, 24A between the power output shaft 25 of the drive 6 and the input shaft 17 of the fabric mandrel 3. The drive 6 such as an electric motor is mounted on a bracket 6A provided with an elongated guide hole 6B. A guide and mounting pin 6C passes through the guide hole 6B. The guide pin 6C is mounted to a fork and bushing element 6E secured to the top of a shaft 6D. The shaft 6D in turn is held in a bushing 6G which is mounted by a bracket 6F to the loom frame LF. This type of mounting permits three adjustments for the position of the drive motor 6. First, the motor can be moved horizontally back and forth as indicated by the arrow 26, whereby the pin 6C slides in the guide hole 6B. Second, the motor can be tilted about the pin 6C as indicated by the arrow 27. Third, the entire mounting and motor can be angularly adjusted about the longitudinal axis LA of the shaft 6D as indicated by the arrow 28. Thus, the drive 6 can be so positioned that the coupling pin 25A at the end of the drive shaft 25 can engage the groove 24A in the coupling head 24 at the end of the shaft 17. Once coupling is accomplished, the drive 6 will be fixed in the driving position by screw connections not shown.

FIG. 4 illustrates another single drive 6' for the mandrel or mandrels in respective trolleys 5, 5A. The drive or transmission 6' comprises a gear 11 coupled through a belt or chain drive 10 to the main loom drive 1', whereby a releasable pulley 11A permits disconnecting the drive belt 10A from the gear drive 11 when a trolley 5 needs to be exchanged. The pulley 11A may be secured to a mounting shaft of one of the gear wheels whereby a set screw or the like permits opening the drive train just described.

Although the invention has been described with reference to specific example embodiments, it will be appreciated that it is intended to cover all modifications and equivalents within the scope of the appended claims.

What is claimed is:

1. A weaving loom comprising a loom frame, a fabric winding space (1A) in said loom frame (LF), at least one trolley (5) fitting into said fabric winding space of said weaving loom, at least one fabric winding mandrel rotatably mounted in said trolley, a single drive (6, 6') mounted for driving one or more fabric winding mandrels, and a releasable coupling between said single drive and said fabric winding mandrel (6, 6') so that the same drive can be coupled to one or more fabric winding mandrels, said single drive comprising a mounting device (6A, 6B, 6C, 6D, 6E, 6F) for securing said single drive to said loom frame (LF) in a position adjustable manner, and wherein said mounting device comprises a mounting shaft (6D) rotatable in a bushing (6G) secured to said loom frame (LF) for a first angular adjustment (28) of said single drive (6) about a vertical axis (LA), and a bracket (6A) with an elongated guide hole (6B), a guide pin securing said single drive to said bracket (6A) for a linear back and forth adjustment (26) by a sliding movement of said guide pin in said guide hole (6B), said guide pin (6C) further permitting a second angular adjustment (27) of said drive (6) about said guide pin (6C).

2. The weaving loom of claim 1, further comprising at least one first positioning stop member (18) on said trolley and at least one second positioning stop member (19) on said loom frame, said first and second stop members (18, 19) cooperating with each other for aligning said trolley with said loom frame.

3. The weaving loom of claim 1, further comprising at least one first locking element (7) secured to said loom frame, at least one second locking element (9) secured to said trolley (5), and an arresting pin (7) for engaging said first and second locking elements, whereby said trolley is locked in a defined position in said fabric winding space (1A) in said loom.

4. The weaving loom of claim 1, wherein said releasable coupling comprises a first coupling member (25A) rigidly secured to a drive shaft (25) of said single drive and a second coupling member (24, 24A) rigidly secured to a shaft (17) of said mandrel for positively but releasably interconnecting said single drive with said mandrel.

5. The weaving loom of claim 1, wherein said single drive is a central drive.

6. The weaving loom of claim 1, wherein said single drive is a low r.p.m. drive.

7. The weaving loom of claim 1, wherein said single drive comprises a gear (11) connected to said mandrel (5), a main loom drive (1'), and a transmission (10) connecting said main loom drive (1') to said gear (11).

8. The weaving loom of claim 1, further comprising a fabric spreader shaft (2) rotatably mounted in said loom frame above said fabric winding space (1A) for presenting fabric for winding onto said fabric winding mandrel (3).

9. A weaving loom comprising a loom frame, a fabric winding space (1A) in said loom frame (LF), at least one trolley (5) fitting into said fabric winding space of said weaving loom, at least one fabric winding mandrel rotatable mounted in said trolley, a single drive (6, 6') mounted for driving one or more fabric winding mandrels, and a releasable coupling between said single drive and said fabric winding mandrel (6, 6') so that the same drive can be coupled to one or more fabric winding mandrels, wherein each trolley comprises a mandrel shaft (17), a bearing (16) rotatably mounting said mandrel shaft in said trolley for supporting said fabric winding mandrel (3), wherein said releasable coupling comprises a first coupling member (25A) connected to said single drive (6, 6') and a second coupling member (24, 24A) secured to one end of said mandrel shaft (17) for releasably coupling said mandrel shaft to said first coupling member, and further comprising third coupling members (17B, 17C) at an opposite end of said mandrel shaft (3, 3A) so that mandrel shafts of at least two trolleys can be coupled in series with each other for driving all mandrels by said single drive (6 or 6').

10. The weaving loom of claim 9, further comprising latch members (23, 23A) connected to said trolleys for interlocking said trolleys with each other.

11. A fabric winding mandrel trolley for a weaving loom, said mandrel trolley comprising a trolley frame, two upright members (14, 15) mounted on said trolley frame, wheels supporting said trolley frame, two bearings (16), one of which is mounted in each of said upright members, a fabric winding mandrel (3) rotatably mounted in said bearings, stop members (18) on said trolley for positioning said trolley in said weaving loom, a releasable coupling at least at one end of said mandrel for releasably connecting said mandrel to a single power drive, said mandrel trolley further comprising a mandrel shaft (17) carrying said mandrel (3, 3A), said mandrel shaft being mounted in said bearings in said upright members, said releasable coupling being connected to at least one end of said shaft (17), and wherein said releasable coupling is arranged at each end of said mandrel shaft of at least one trolley for connecting at least two trolleys in series with each other and to said single power drive.

12. The mandrel trolley of claim 11, further comprising latch members (23, 23A) connected to said trolleys for interlocking said at least two trolleys with each other.

13. The mandrel trolley of claim 11, further comprising a smoothing roller (22) and a vertical guide slot (21A) in each of said upright member (14, 15) for guiding a vertical movement of said smoothing roller (22).

14. The mandrel trolley of claim 13, further comprising a mounting bracket (21) secured to each of said upright members, said vertical guide slot (21A) being provided in each mounting bracket (21).

15. The mandrel trolley of claim 11, further comprising interlocking elements (7, 8, 9) for releasably locking said trolley to said loom.

16. The mandrel trolley of claim 11, further comprising a stepping board (20) mounted on said trolley frame.

* * * * *

UNITED STATES PATENT AND TRADEMARK OFFICE

CERTIFICATE OF CORRECTION

PATENT NO. : 5,794,885

DATED : August 18, 1998

INVENTOR(S) : Husek et al.

It is certified that error appears in the above-identified patent and that said Letters Patent is hereby corrected as shown below:

On the Title Page:

Under [75] Inventors: line 3, replace "n.N, all of Germany" by --all of Czech Republic--.

Under [56] References Cited U.S. PATENT DOCUMENTS: line 3, replace "Suwa" by --Suwa et al.--.

Col. 5, line 39, after "drive" (first occurrence) insert --or transmission--.

Signed and Sealed this

Twenty-fourth Day of November, 1998

*Attest:*

Bruce Lehman

BRUCE LEHMAN

*Attesting Officer*

*Commissioner of Patents and Trademarks*